US005697610A

United States Patent [19]

Holmes et al.

[11] Patent Number: 5,697,610

[45] Date of Patent: Dec. 16, 1997

[54] MAIL SEPARATING DEVICE WITH STOP DEVICE COOPERATING WITH SENSOR

[75] Inventors: Lawrence B. Holmes, Hunt Valley, Md.; Massimo Camoriano, Genoa; Renato Gritti, Rapallo, both of Italy

[73] Assignee: Finmeccanica S.p.A., Rome, Italy

[21] Appl. No.: 514,209

[22] Filed: Aug. 11, 1995

[30] Foreign Application Priority Data

Aug. 12, 1994 [IT] Italy ..... TO94A0665

[51] Int. Cl.[6] ..... B65H 7/12

[52] U.S. Cl. ..... 271/263; 271/265.04; 271/272; 271/275; 271/182

[58] Field of Search ..... 271/121, 262, 271/263, 265.04, 275, 277, 2, 182, 272

[56] References Cited

U.S. PATENT DOCUMENTS

| | | | |
|---|---|---|---|
| 3,186,708 | 6/1965 | Hinz . | |
| 3,955,812 | 5/1976 | Suda et al. | 271/182 X |
| 4,798,646 | 1/1989 | Sumi | 271/262 X |

FOREIGN PATENT DOCUMENTS

| | | | |
|---|---|---|---|
| 0 582 869 | 7/1993 | European Pat. Off. . | |
| 1266037 | 4/1968 | Germany . | |
| 1267012 | 4/1968 | Germany . | |
| 53365 | 4/1977 | Japan | 271/263 |
| 35705 | 3/1980 | Japan | 271/121 |
| 78750 | 6/1981 | Japan | 271/121 |
| 112548 | 6/1985 | Japan | 271/262 |
| 258063 | 12/1985 | Japan | 271/263 |
| 31636 | 2/1987 | Japan | 271/263 |
| 1093038 | 11/1967 | United Kingdom . | |

OTHER PUBLICATIONS

Wilson, "Cassette with Paper-Resistraint Finger", IBM Tech. Disc. Bull., vol. 24, No. 7B, Dec. 1981, p. 3765.

Bielling et al, "Second Street Restraint", IBM Tech. Disc. Bull. vol. 23, No. 9, Feb. 1981 p. 3957.

*Primary Examiner*—Boris Milef

*Attorney, Agent, or Firm*—Lowe, Price, LeBlanc & Becker

[57] ABSTRACT

A mail separating device has a conveyor channel, an input of which is connected to a sorting device for successively supplying the channel with flat mail items. The separating device includes a sensor which is located along the channel for generating a double-withdrawal signal on detecting a pair of at least partly superimposed mail items. The double-withdrawal signal activates a stop device, which is located along the channel and moves an appendix from an idle position to an activating position. A stop portion of the appendix contacts the vertical end edge of a first item in the pair. The impact of the stop portion on the vertical end edge arrests the first item while the second item in the pair continues traveling along the channel and is detached from the first item.

16 Claims, 3 Drawing Sheets

MAIL SEPARATING DEVICE WITH STOP DEVICE COOPERATING WITH SENSOR

BACKGROUND OF THE INVENTION

The present invention relates to a mail separating device.

Mail sorting devices are known which provide for withdrawing flat rectangular mail items one at a time from a stack of superimposed items, and for feeding the items to a conveyor channel along which they travel separately.

European Patent Application EP-A-582.869 by FINMECCANICA S.p.A., for example, relates to a sorting device comprising an inclined rectangular surface for supporting a stack of mail items, which is pushed by a slide along the inclined surface to a stop device fitted to the upper end edge of the surface. The sorting device also comprises a gripping head movable in crank and slotted link manner to and from the inclined surface, and which provides for withdrawing the mail items one at a time from the stack and feeding them to the conveyor channel. More specifically, the gripping head conveniently comprises a number of suction cups which engage the front surface of the item contacting the stop device.

Due to the adhesion (e.g. electrostatic adhesion) of adjacent items in the stack, pairs of adjacent, superimposed items may inadvertently be withdrawn (multiple withdrawal) and fed as such to the conveyor channel.

SUMMARY OF THE INVENTION

It is an object of the present invention to provide a separating device for determining multiple withdrawal, and for separating the items withdrawn simultaneously.

According to the present invention, there is provided a mail separating device, characterized in that it comprises:

- a conveyor channel presenting an input connected to a feed device for successively supplying the channel with flat mail items;
- conveyor means for feeding said items along the channel;
- first sensor means located along said channel, and for generating a double-withdrawal signal on detecting a pair of at least partly superimposed mail items traveling along the channel; and
- stop means located along said channel and cooperating with said first sensor means;
- said stop means comprising at least one appendix movable by actuating means between an idle position, and an activating position wherein a stop portion of said appendix is located along said channel;
- said stop portion being set to said activating position upon detection of said double-withdrawal signal; and
- said stop portion in said activating position also intercepting an end edge (E2) of a first mail item in said pair of mail items.

BRIEF DESCRIPTION OF THE DRAWINGS

A preferred, non-limiting embodiment of the present invention will be described by way of example with reference to the accompanying drawings, in which.

DETAILED DESCRIPTION OF THE INVENTION

Figure 1:
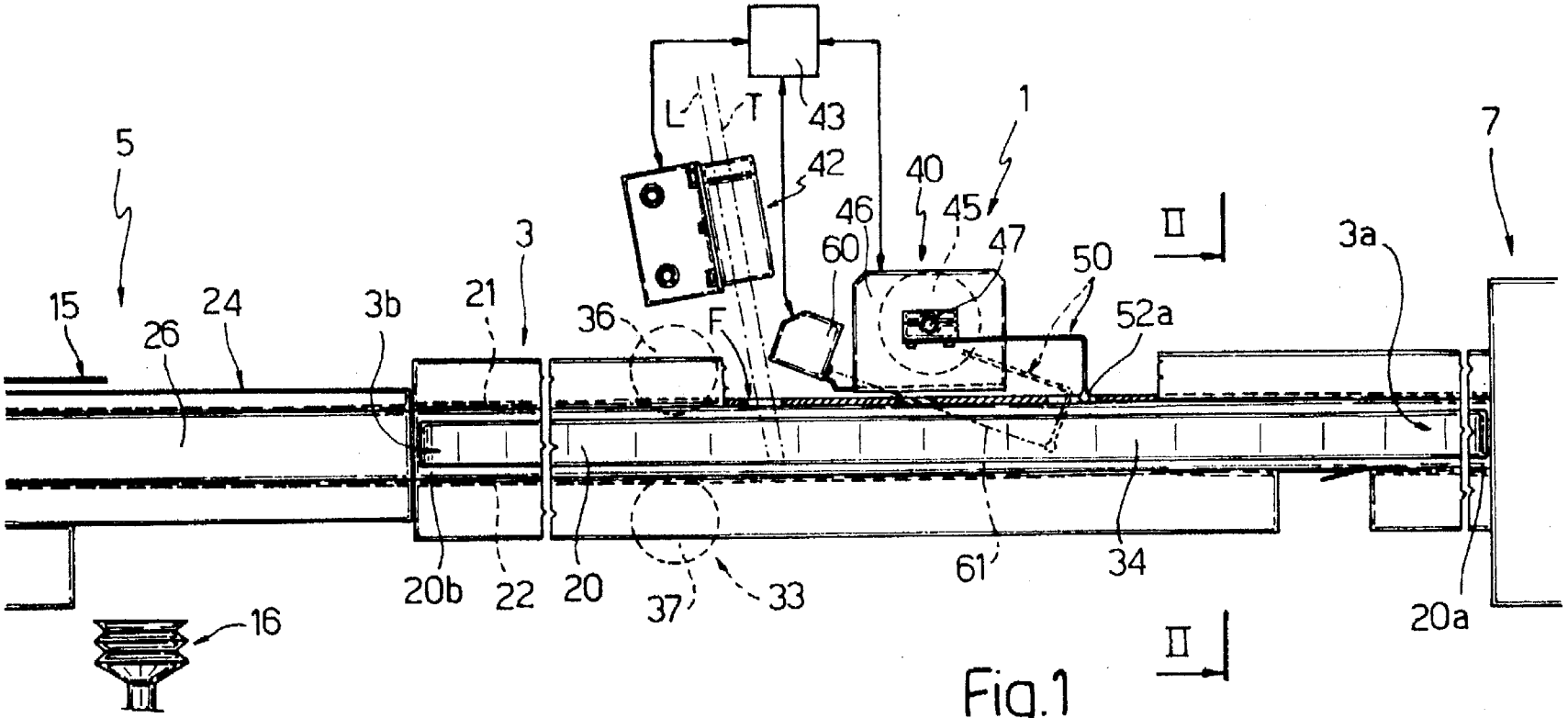
FIG. 1 shows a top plan view of a separating device in accordance with the teachings of the present invention.

Number 1 in FIG. 1 indicates a mail separating device located along a straight conveyor channel 3 extending between a known sorting device 5 (shown partly and schematically in FIG. 1) and an unloading device 7 (also shown schematically).

Figure 4:
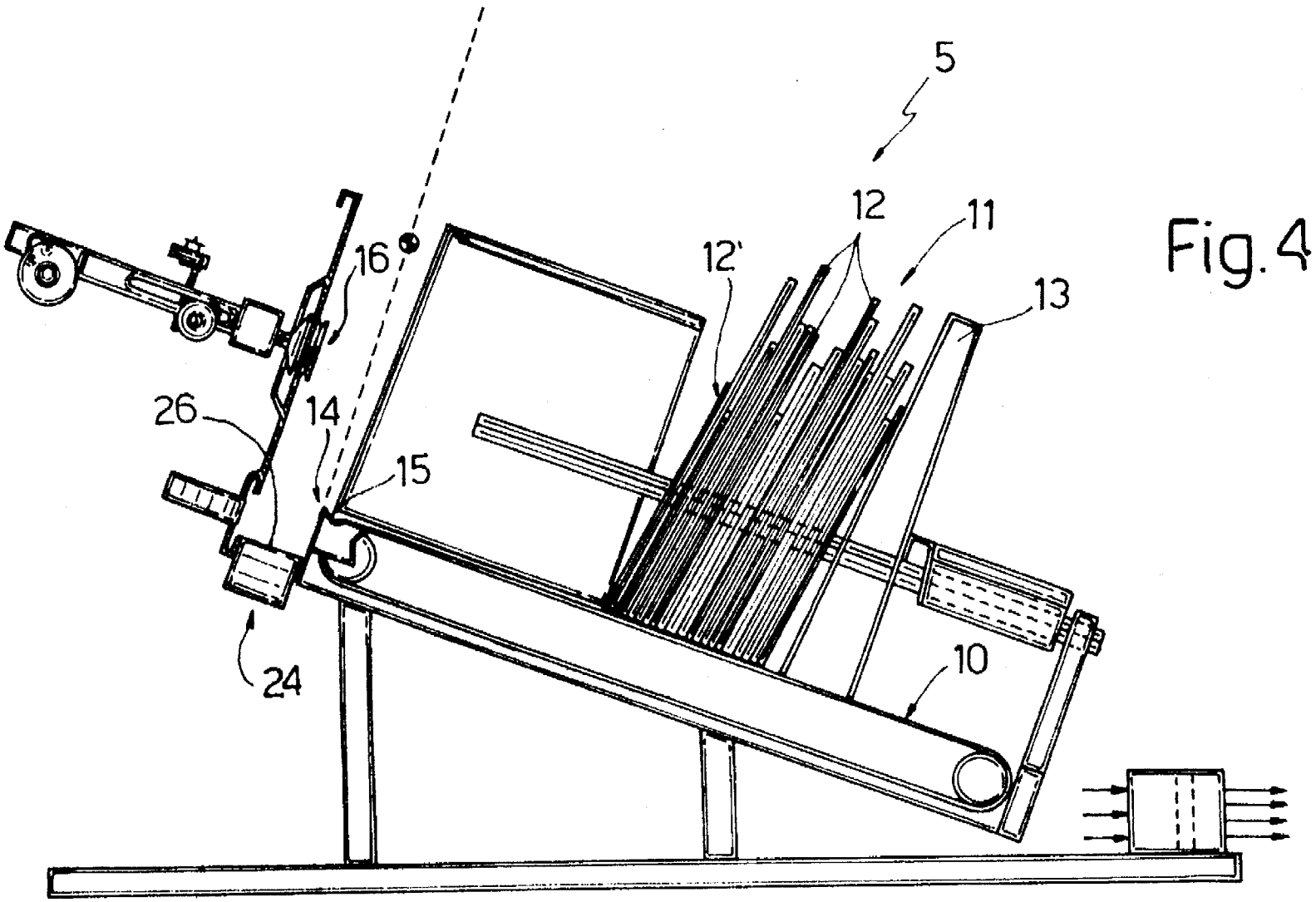
FIG. 4 shows a sorting device which may be used for supplying mail items to the separating device according to the present invention.

Sorting device 5 may, for example, be of the type described in European Patent Application EP-A-582.869 by FINMECCANICA S.p.A., and may comprise (FIG. 4) an inclined rectangular surface 10 for supporting a stack 11 of flat rectangular mail items 12 (letters, envelopes, magazines, newspapers, etc.) which is pushed by a slide 13 along inclined surface 10 to a stop device 14 fitted to the upper end edge 15 of surface 10. Sorting device 5 also comprises a gripping head 16 movable in crank and slotted link manner to and from inclined surface 10, and for withdrawing mail items 12 one at a time from stack 11, and feeding them to conveyor channel 3. More specifically, gripping head 16 conveniently comprises a number of suction cups for engaging the front surface 12' of the item 12 contacting stop device 14.

Figure 3:
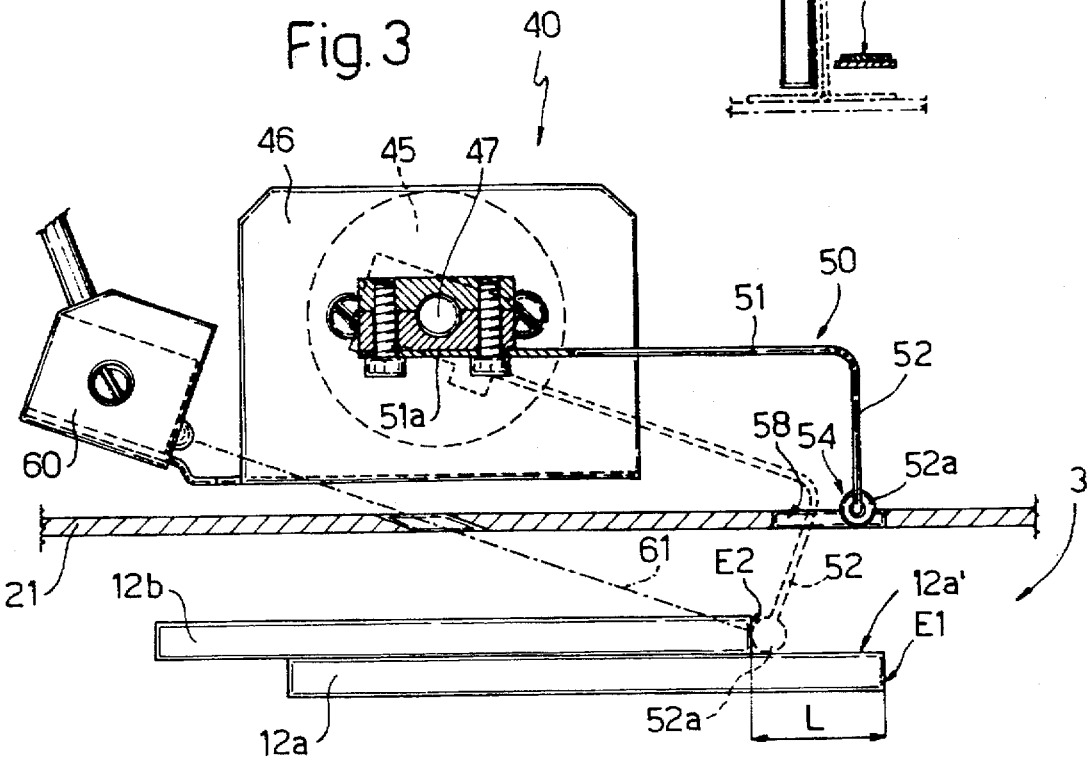
FIG. 3 shows a larger-scale detail of the FIG. 1 device.

Due to the adhesion (e.g. electrostatic adhesion) of items 12 in the stack, pairs of adjacent, superimposed items **12*a*, 12*b* (FIG. 3) may inadvertently be withdrawn and fed as such to conveyor channel 3**.

Separating device 1 provides for detecting and separating such pairs of items **12*a*, 12*b***.

Figure 2:
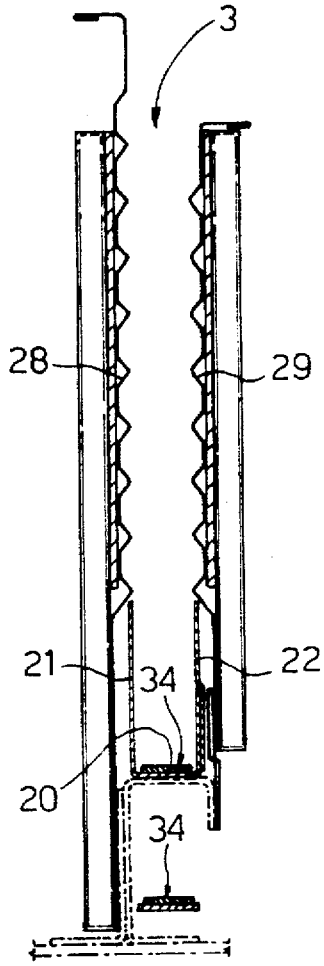
FIG. 2 shows a section of the separating device along line II—II in FIG. 1.

As shown particularly in FIGS. 1 and 2, straight channel 3 presents a rectangular cross section, and defined by a rectangular bottom wall 20 and two rectangular lateral walls 21, 22 cooperating with sheets 28, 29 of undulated synthetic material extending inside and along the full length of channel 3, for enabling smooth slide of items 12 along the channel.

Bottom wall 20 extends from an end edge **20*a* (corresponding to output 3*a* of channel 3) adjacent to unloading device 7, to an end edge 20*b* (corresponding to input 3*b* of channel 3) adjacent to the output of a conveyor belt device 24 of sorting device 5. More specifically, conveyor belt device 24 comprises a straight horizontal belt 26 parallel to and beneath end edge 15, and which provides for feeding the mail items released on to it by gripping head 16 towards edge 20*b***.

Conveyor channel 3 comprises a number of known pinch roller devices 33 located along walls 21, 22 and which provide for moving items 12 along channel 3.

Each pinch roller device 33 comprises a first powered roller 36 fitted to wall 21; and a second powered roller 37 located close to a rectangular opening (not shown) in wall 22, and which is movable between an idle position wherein it is clear of channel 3, and an activating position wherein it engages the opening and roller 36. Rollers 36, 37 provide for engaging opposite bottom surfaces of item 12 inside channel 3, and in particular for rapidly accelerating item 12.

Conveyor channel 3 also comprises a bottom conveyor belt 34 parallel to bottom wall 20, and which extends from input **3*b* to output 3*a* of channel 3, and is moved from sorting device 5 to unloading device 7** by actuating means (not shown).

As shown particularly in FIG. 1, separating device 1 comprises a stop assembly 40 substantially halfway along channel 3; and a laser sensor 42 located between input **3*b* of channel 3 and stop assembly 40**.

Sensor 42 comprises a photoemitting device (not shown), and a photoreceiving device (not shown) for receiving the light reflected and diffused by items 12. The photoemitting and photoreceiving devices (not shown) are positioned facing the channel, and define respective optical paths L, T extending through a hole F (FIG. 1) in wall 21, and forming an angle of roughly 80° with channel 3. Sensor 42 cooperates with an electronic unit 43 for receiving, and detecting rapid variations in, the electric signal generated by the photoreceiving device (not shown), which rapid variations correspond to discontinuity of item 12, as explained in more detail later on.

Stop assembly 40 comprises a cylindrical electromagnetic actuator 45 fitted to a rectangular metal bracket 46 extending perpendicularly from wall 21 and outwards of channel 3; and actuator 45 presents an output shaft 47 parallel to walls 21, 22 and supporting an L-shaped plate 50. More specifically (FIG. 3), plate 50 comprises a first straight portion 51 with a first end 51*a* fitted to shaft 47; and a second straight portion 52 perpendicular to and shorter than portion 51, and presenting a rounded end 52*a* with a reflecting surface 54, the function of which is explained later on. Plate 50 engages an elongated rectangular opening 58 (FIG. 3) in wall 21, and is movable by actuator 45 between an idle position (shown by the continuous line in FIGS. 1 and 3) wherein portion 51 is parallel to wall 21, and rounded end 52*a* projects slightly from wall 21 into channel 3, and an activating position (shown by the dotted line) wherein portion 51 is inclined in relation to wall 21, and portion 52 engages opening 58 and penetrates inside channel 3 with rounded portion 52*a* positioned substantially halfway across the channel.

Stop device 40 also presents a sensor 60 (conveniently comprising a photocell) fitted to bracket 46 and defining an optical path 61 extending through wall 21 (through an opening shown in FIG. 3) and which intersects rounded portion 52*a* when plate 50 is in the activating position.

In actual use, mail items 12 are withdrawn by gripping head 16 from stack 11 and released on to conveyor belt device 24 by which they are fed to conveyor channel 3 where they continue moving in known manner by means of conveyor belt 34 and pinch rollers 33 which close to engage bottom portions of items 12. In this way, items 12 travel from input 3*b* to output 3*a* of channel 3 at a speed of roughly 2.7–3 meters/second.

In the event of a multiple withdrawal (FIG. 3), the two items 12*a*, 12*b* withdrawn simultaneously are parallel to each other but not completely superimposed, in that, for physical reasons not described, a first item (e.g. 12*a*) presents a vertical end edge E1 separated by length L (of at least 10 millimeters) from the corresponding vertical end edge E2 of the other item (e.g. 12*b*). End edge E2 of item 12*b* defines, on the flat surface 12*a*' of item 12*a*, a step-shaped discontinuity which reflects light differently from the flat surfaces adjacent to it, and which is detected (in known manner) by unit 43 via sensor 42.

After a first time interval T1 from detection of the discontinuity, electromagnetic actuator 45 is activated to rapidly move plate 50 from the idle to the activating position, so that end 52*a* of portion 52 contacts the exposed portion of surface 12*a*' and hence end edge E2 of item 12*b*.

The impact of portion 52*a* on edge E2 stops item 12*b*, whereas item 12*a* continues moving along channel 3 either by inertia or conveyed by bottom conveyor belt 34, so that items 12*a*, 12*b* are detached from each other.

Correct engagement of edge E2 by end 52*a* interrupts optical path 61 (FIG. 3), the detection of which interruption indicates correct stoppage of item 12*b* and hence detachment of it from item 12*a*.

After a second time interval T2 from detection of the interruption of optical path 61, electromagnetic actuator 45 is again activated to rapidly move plate 50 from the activating to the idle position.

As such, item 12*b* is detached from plate 50 and is once more fed along channel 3 by bottom conveyor belt 34.

Separating device 1 thus provides for detecting multiple withdrawals and separating the items withdrawn simultaneously.

Clearly, changes may be made to the separating device as described and illustrated herein without, however, departing from the scope of the present invention.

We claim:

1. A mail separating device, characterized in that it comprises:

a conveyor channel (3) defined by two walls (21, 22) and presenting an input (3*b*) for receiving flat mail items (12);

conveyor means (33, 34) for feeding said items (12) along the channel (3), said conveyor means comprising a conveyor belt (34) distinct from said walls (20, 21) and extending along said channel (3);

first sensor means (42) located along said channel (3), and for generating a double-withdrawal signal on detecting a pair of at least partly superimposed mail items (12) traveling along the channel (3); and stop means (40) located along said channel (3) and cooperating with said first sensor means (42) for stopping at least one of said pair of mail items;

said first sensor means (42) being disposed between said input (3*b*) and said stop means in order to detect said pair of superimposed mail items approaching the stop means;

said stop means (40) comprising at least one appendix (50) movable between an idle position, and an activating position wherein a stop portion (52*a*) of said appendix (50) is located along said channel (3);

said stop portion (52*a*) being set to said activating position upon detection of said double-withdrawal signal; and said stop portion (52*a*) in said activating position also intercepting an end edge (E2) of a first mail item (12*b*) in said pair (12*a*, 12*b*) of mail items.

2. A device as claimed in claim 1, characterized in that said stop means (40) comprise actuating means (45) located along said channel (3) and presenting at least an output shaft (47) activating said movable appendix (50).

3. A device as claimed in claim 2, characterized in that said movable appendix comprises an L-shaped plate (50).

4. A device as claimed in claim 3, characterized in that said L-shaped plate (50) comprises a first straight portion (51) with one end (51*a*) fitted to said shaft (47); and a second straight portion (52) perpendicular to and shorter than said first portion (51).

5. A device as claimed in claim 3, characterized in that said plate (50) presents a rounded end (52*a*) forming said stop portion.

6. A device as claimed in claim 1, characterized in that said channel (3) presents a substantially rectangular section.

7. A device as claimed in claim 1, characterized in that said channel (3) is substantially straight.

8. A device as claimed in claim 1, characterized in that said conveyor means comprise a number of pinch roller devices (33) located along the channel;

each pinch roller device (33) presenting at least two rollers (36, 37), at least one (37) of which is powered, and which engage opposite lateral portions of said mail items (12).

9. A device as claimed in claim 1, wherein said two walls (21, 22) are substantially vertical, and said conveyor belt (34) is substantially horizontal, said conveyor belt (34) located between and at a bottom of said pair of walls.

10. A mail separating device, characterized in that it comprises:

a conveyor channel (3) presenting an input (3*b*) for receiving (3) flat mail items (12);

conveyor means (33, 34) for feeding said items (12) along the channel (3);

first sensor means (42) located along said channel (3), and for generating a double-withdrawal signal on detecting a pair of at least partly superimposed mail items (12) traveling along the channel (3); and stop means (40) located along said channel (3) and cooperating with said first sensor means (42) for stopping at least one of said pair of mail items;

wherein said stop means (40) comprises at least one appendix (50) movable between an idle position and an activating position wherein a stop portion (52*a*) of said appendix is located along said channel and second sensor means (60) defining at least an optical path (61) facing said channel (3) and which is intersected by an outer surface (54) of said stop portion (52*a*) in said activating position said stop portion being engageble with a mail item in said activating position;

said optical path (61) being interrupted by a first item (12*b*) of said pair of mail items when the first item (12*b*) is correctly engaged by said stop portion (52*a*).

11. A mail separating device, comprising:

a conveyor channel (3) presenting an input (3*b*) for receiving (3) flat mail items (12);

conveyor means (33, 34) for feeding said mail items (12) along the channel (3);

said channel defined by a pair of walls substantially parallel to said mail pieces and said conveyor means comprising a conveying surface substantially perpendicular to said pair of walls for transporting said mail pieces;

first sensor means (42) located along said channel (3) for generating a double-withdrawal signal on detecting a pair of at least partly superimposed mail items (12) traveling along the channel (3); and stop means (40) located along said channel (3) and operating in response to said first sensor means (42) for stopping at least one of said pair of mail items;

said first sensor means (42) being disposed between said input (3*b*) and said stop means in order to detect said pair of superimposed mail items approaching the stop means;

said stop means (40) comprising at least one appendix (50) movable between an idle position, and an activating position wherein a stop portion (52*a*) of said appendix (50) is located along said channel (3);

said stop portion (52*a*) being set to said activating position upon detection of said double-withdrawal signal; and said stop portion (52*a*) in said activating position intercepting and impacting on a leading end edge (E2) of a first mail item (12*b*) in said pair (12*a*, 12*b*) of mail items.

12. A device as claimed in claim 11, wherein said stop portion comprises an impact structure which, when in said activating position, impacts on the leading edge of said first mail item thereby to separate said first mail item from the other mail item of said pair of mail items.

13. A device as claimed in claim 12 further comprising actuating means for moving said at least one appendix, wherein said at least one appendix is mounted on an output shaft of said actuating means, said at least one appendix being rotated by said output shaft between said idle position and said activating position.

14. A device as claimed in claim 11 further comprising actuating means for moving said at least one appendix, wherein said at least one appendix is mounted on an output shaft of said actuating means, said at least one appendix being rotated by said output shaft between said idle position and said activating position.

15. A device as claimed in claim 14, wherein:

said output shaft is substantially parallel to said pair of walls defining said channel and substantially perpendicular to said conveying surface; and said stop portion of said appendix moving into said channel through an opening in one of said pair of walls to impact on a leading edge of said first mail item, thereby to separate said first mail item from the other mail item of said pair of mail items, when said appendix is moved to said activating position.

16. A device as claimed in claim 11, wherein said pair of walls defining said channel are substantially vertical, and said conveying surface is substantially horizontal, said conveying surface located between and at a bottom of said pair of walls.

* * * * *